US008540486B2

(12) United States Patent
Johnson

(10) Patent No.: US 8,540,486 B2
(45) Date of Patent: Sep. 24, 2013

(54) APPARATUS FOR COOLING A BUCKET ASSEMBLY

(75) Inventor: David Martin Johnson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 856 days.

(21) Appl. No.: 12/728,517

(22) Filed: Mar. 22, 2010

(65) Prior Publication Data

US 2011/0229344 A1 Sep. 22, 2011

(51) Int. Cl.
*F01D 5/08* (2006.01)

(52) U.S. Cl.
USPC ..... 416/96 R; 416/97 R; 416/193 A

(58) Field of Classification Search
USPC ..... 415/115, 116, 139; 416/96 R, 97 R, 416/193 A
See application file for complete search history.

(56) References Cited

U.S. PATENT DOCUMENTS 2,912,223 A * 11/1959 Hull, Jr. ..... 416/221
3,834,831 A 9/1974 Mitchell
6,341,939 B1 1/2002 Lee
6,428,270 B1 8/2002 Leone et al.
6,719,529 B2 * 4/2004 Tiemann ..... 416/97 R
6,776,583 B1 8/2004 Wang et al.
7,147,440 B2 12/2006 Benjamin et al.
7,189,063 B2 3/2007 Honkomp
7,628,588 B2 12/2009 Itzel et al.
2005/0095129 A1 * 5/2005 Benjamin et al. ..... 416/97 R
2007/0269315 A1 * 11/2007 Funk et al. ..... 416/219 R

* cited by examiner

*Primary Examiner* — Nathaniel Wiehe
*Assistant Examiner* — Adam W Brown
(74) *Attorney, Agent, or Firm* — Dority & Manning, PA

(57) ABSTRACT

A bucket assembly cooling apparatus is provided. The bucket assembly includes a platform, an airfoil, and a shank. The airfoil may extend radially outward from the platform. The shank may extend radially inward from the platform. The shank may include a pressure side sidewall, a suction side sidewall, an upstream sidewall, and a downstream sidewall. The sidewalls may at least partially define a cooling circuit. The cooling circuit may be configured to receive a cooling medium and provide the cooling medium to the airfoil. The upstream sidewall may at least partially define an interior cooling passage and at least partially define an exterior ingestion zone. The cooling passage may be configured to provide a portion of the cooling medium from the cooling circuit to the ingestion zone of an adjacent bucket assembly.

19 Claims, 6 Drawing Sheets

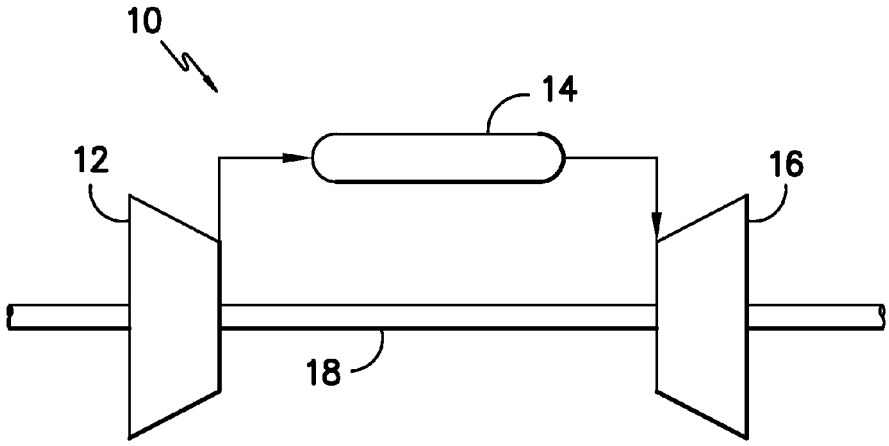
FIG. –1–
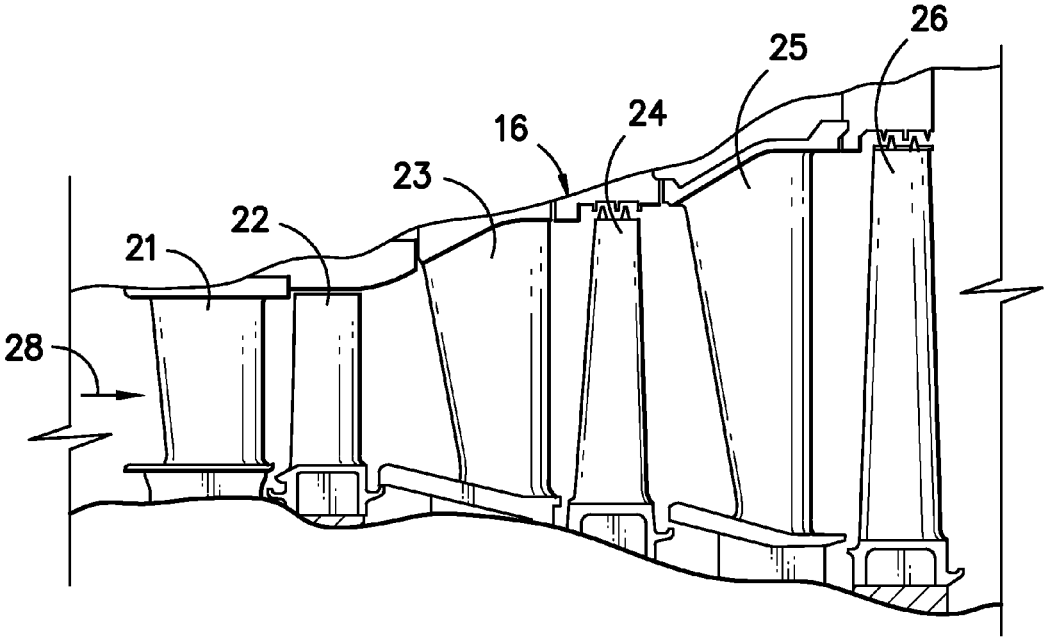
FIG. –2–

FIG. –5–

APPARATUS FOR COOLING A BUCKET ASSEMBLY

FIELD OF THE INVENTION

The subject matter disclosed herein relates generally to turbine buckets, and more specifically to cooling apparatus for bucket assembly components.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flow must be cooled to allow the gas turbine system to operate at increased temperatures.

Various strategies are known in the art for cooling various gas turbine system components. For example, a cooling medium may be routed from the compressor and provided to various components. In the turbine section of the system, the cooling medium may be utilized to cool various turbine components.

Turbine buckets are one example of a hot gas path component that must be cooled. Imperfectly sealed bucket shanks may allow hot gas to enter the shanks, and the hot gas can cause the bucket to fail. For example, in some shanks, when the hot gas entering the shank is above approximately 1900° F., the hot gas can cause shank seal pins to creep and deform, and may cause the seal pins to extrude from the shanks. Further, the hot gas can damage the shank damper pins and the shanks themselves, resulting in failure of the buckets.

Various strategies are known in the art for cooling bucket shank components and preventing hot gas ingestion. For example, one prior art strategy utilizes a high pressure flow of the cooling medium to pressurize the shank cavities, providing a positive back-flow margin for all hot gas ingestion locations on the shank. This positive back-flow margin prevents the hot gas from entering and damaging the shanks. However, the amount of cooling medium that must be routed from the compressor to pressurize the shank cavities is substantial, and this loss of flow through the compressor results in losses in performance, efficiency, and power output of the gas turbine system. Further, a substantial amount of the cooling medium provided to pressurize the shank cavities is leaked and emitted from the shank cavities into the hot gas path, resulting in a waste of this cooling medium.

Thus, a cooling apparatus for a bucket shank would be desired in the art. For example, a cooling apparatus that minimizes the amount of cooling medium routed from the compressor and the amount of cooling medium wasted and lost during cooling of the bucket shank would be advantageous. Further, a cooling apparatus that maximizes the performance, efficiency, and power output of the gas turbine system while effectively cooling the bucket shank would be advantageous.

BRIEF DESCRIPTION OF THE INVENTION

Aspects and advantages of the invention will be set forth in part in the following description, or may be obvious from the description, or may be learned through practice of the invention.

In one embodiment, a bucket assembly is provided that includes a platform, an airfoil, and a shank. The airfoil may extend radially outward from the platform. The shank may extend radially inward from the platform. The shank may include a pressure side sidewall, a suction side sidewall, an upstream sidewall, and a downstream sidewall. The sidewalls may at least partially define a cooling circuit. The cooling circuit may be configured to receive a cooling medium and provide the cooling medium to the airfoil. The upstream sidewall may at least partially define an interior cooling passage and at least partially define an exterior ingestion zone. The cooling passage may be configured to provide a portion of the cooling medium from the cooling circuit to the ingestion zone of an adjacent bucket assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic illustration of a gas turbine system;

FIG. 2 is a sectional side view of the turbine section of a gas turbine system according to one embodiment of the present disclosure;

DETAILED DESCRIPTION OF THE INVENTION

Figure 3:
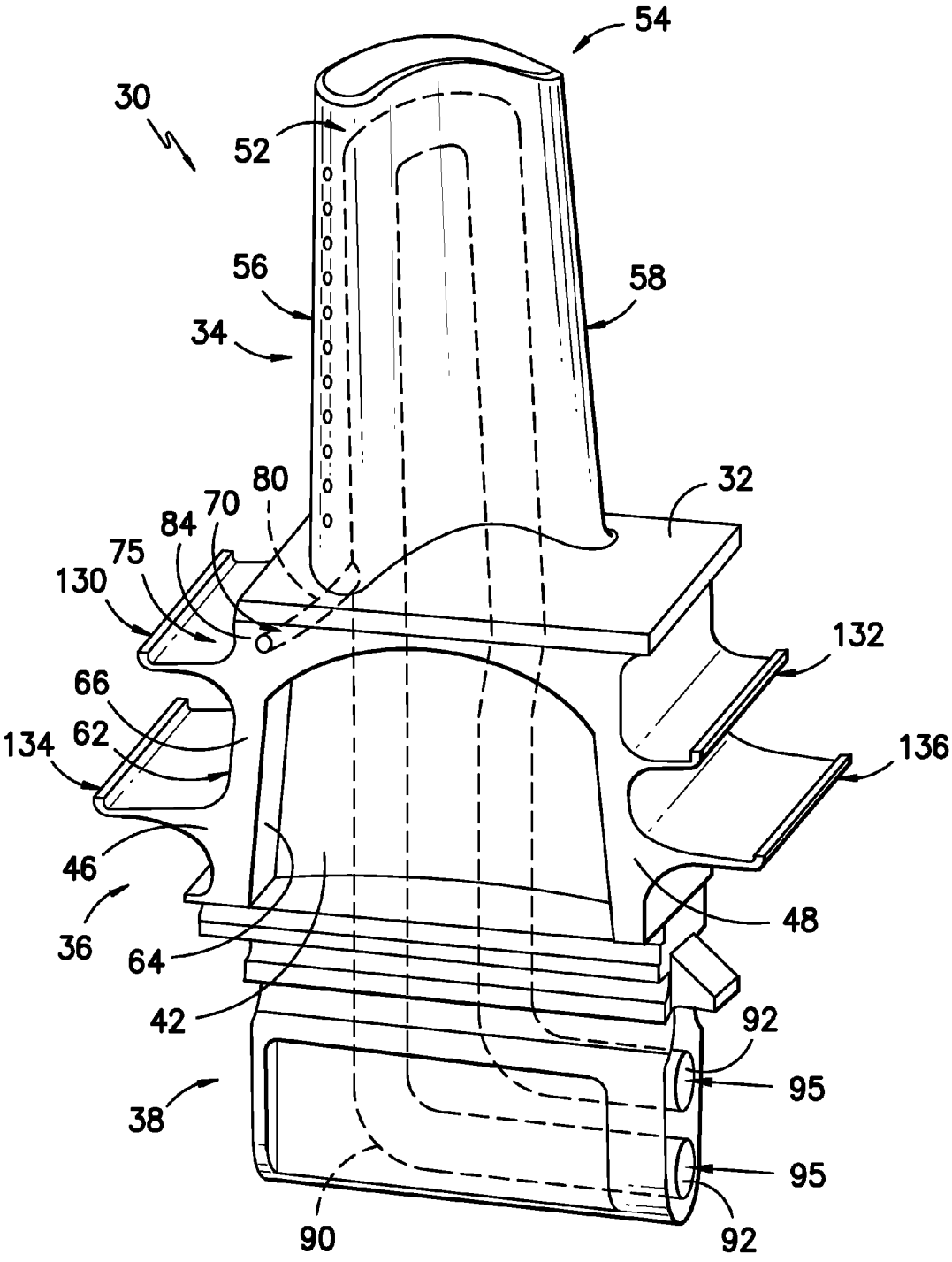
FIG. 3 is a perspective view of a bucket assembly according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

The turbine 16 may include a plurality of turbine stages. For example, in one embodiment, the turbine 16 may have three stages, as shown in FIG. 2. For example, a first stage of the turbine 16 may include a plurality of circumferentially spaced nozzles 21 and buckets 22. The nozzles 21 may be disposed and fixed circumferentially about the shaft 18. The buckets 22 may be disposed circumferentially about the shaft 18 and coupled to the shaft 18. A second stage of the turbine 16 may include a plurality of circumferentially spaced nozzles 23 and buckets 24. The nozzles 23 may be disposed and fixed circumferentially about the shaft 18. The buckets 24 may be disposed circumferentially about the shaft 18 and coupled to the shaft 18. A third stage of the turbine 16 may include a plurality of circumferentially spaced nozzles 25 and buckets 26. The nozzles 25 may be disposed and fixed circumferentially about the shaft 18. The buckets 26 may be disposed circumferentially about the shaft 18 and coupled to the shaft 18. The various stages of the turbine 16 may be disposed in the turbine 16 in the path of hot gas flow 28. It should be understood that the turbine 16 is not limited to three stages, but may have any number of stages known in the turbine art.

Each of the buckets 22, 24, 26 may comprise a bucket assembly 30, as shown in FIG. 3. The bucket assembly 30 may include a platform 32, an airfoil 34, and a shank 36. The airfoil 34 may extend radially outward from the platform 32. The shank 36 may extend radially inward from the platform 32.

The bucket assembly 30 may further include a dovetail 38. The dovetail 38 may extend radially inward from the shank. In an exemplary aspect of an embodiment, the dovetail 38 may be configured to couple the bucket assembly 30 to the shaft 18. For example, the dovetail 38 may secure the bucket assembly 30 to a rotor disk (not shown) disposed on the shaft 18. A plurality of bucket assemblies 30 may thus be disposed circumferentially about the shaft 18 and coupled to the shaft 18, forming a rotor assembly 20, as partially shown in FIGS. 6 and 7.

If desired, the dovetail 38 may be configured to supply a cooling medium 95 to a cooling circuit 90 defined within the bucket assembly 30. For example, inlets 92 of the cooling circuit 90 may be defined by the dovetail 38. The cooling medium 95 may enter the cooling circuit 90 through the inlets 92. The cooling medium 95 may exit the cooling circuit 90 through, for example, film cooling holes, or through any other bucket assembly exit holes, passages, or aperatures.

The cooling medium 95 is generally supplied to the turbine 16 from the compressor 12. It should be understood, however, that the cooling medium 95 is not limited to a cooling medium supplied by a compressor 12, but may be supplied by any system 10 component or external component. Further, the cooling medium 95 is generally cooling air. It should be understood, however, that the cooling medium 95 is not limited to air, and may be any cooling medium.

The airfoil 34 may include a pressure side surface 52 and a suction side surface 54. The pressure side surface 52 and the suction side surface 54 may be connected at a leading edge 56 and a trailing edge 58. The airfoil 34 may at least partially define the cooling circuit 90 therein. For example, the pressure side surface 52 and the suction side surface 54 may at least partially define the cooling circuit 90. The cooling circuit 90 may be configured to receive cooling medium 95 and provide the cooling medium to the airfoil 34. For example, the cooling medium 95 may pass through the airfoil 34 within the cooling circuit 90, cooling the airfoil 34.

The shank 36 may include a pressure side sidewall 42, a suction side sidewall 44 (see FIG. 5), an upstream sidewall 46, and a downstream sidewall 48. The upstream sidewall 46 of the shank 36 may include an exterior surface 62, an interior surface 64, a pressure side surface 66, and a suction side surface 68 (see FIG. 5).

The shank 36 may at least partially define the cooling circuit 90 therein. For example, the sidewalls 42, 44, 46, and 48 may at least partially define the cooling circuit 90. The shank 36 may further include an upstream upper angel wing 130, upstream lower angel wing 134, downstream upper angel wing 132, and downstream lower angel wing 136. The angel wings 130 and 134 may extend outwardly from the upstream sidewall 46, and the angel wings 132 and 136 may extend outwardly from the downstream sidewall 48. The upstream upper angel wing 130 and the downstream upper angel wing 132 may be configured to seal buffer cavities (not shown) defined within the rotor assembly 20. The upstream lower angel wing 134 and the downstream lower angel wing 136 may be configured to provide a seal between the bucket assembly 30 and the rotor disk (not shown).

The shank 36 may further define an exterior ingestion zone 70. The exterior ingestion zone 70 is a zone between adjacent bucket assemblies 30 where the hot gas flow 28 enters the bucket assemblies 30. In an exemplary aspect of an embodiment, the ingestion zone 70 may be at least partially defined with respect to a bucket assembly 30 adjacent the suction side surface 68 of the upstream sidewall 46 and adjacent the platform 32. The ingestion zone 70 may be further defined with respect to a bucket assembly 30 adjacent the pressure side surface 66 of the upstream sidewall 46 and adjacent the platform 32. For example, during operation of the system 10, pressure gradients in the hot gas flow 28 may cause at least a portion of the hot gas flow 28 to be directed into a trench cavity 75 defined by the shank 36. The trench cavity 75 may be defined approximately adjacent the upstream upper angel wing 130. The hot gas flow 28 may be further directed from the trench cavity 75 through the ingestion zone 70 between and into the adjacent bucket assemblies 30.

Figure 5:
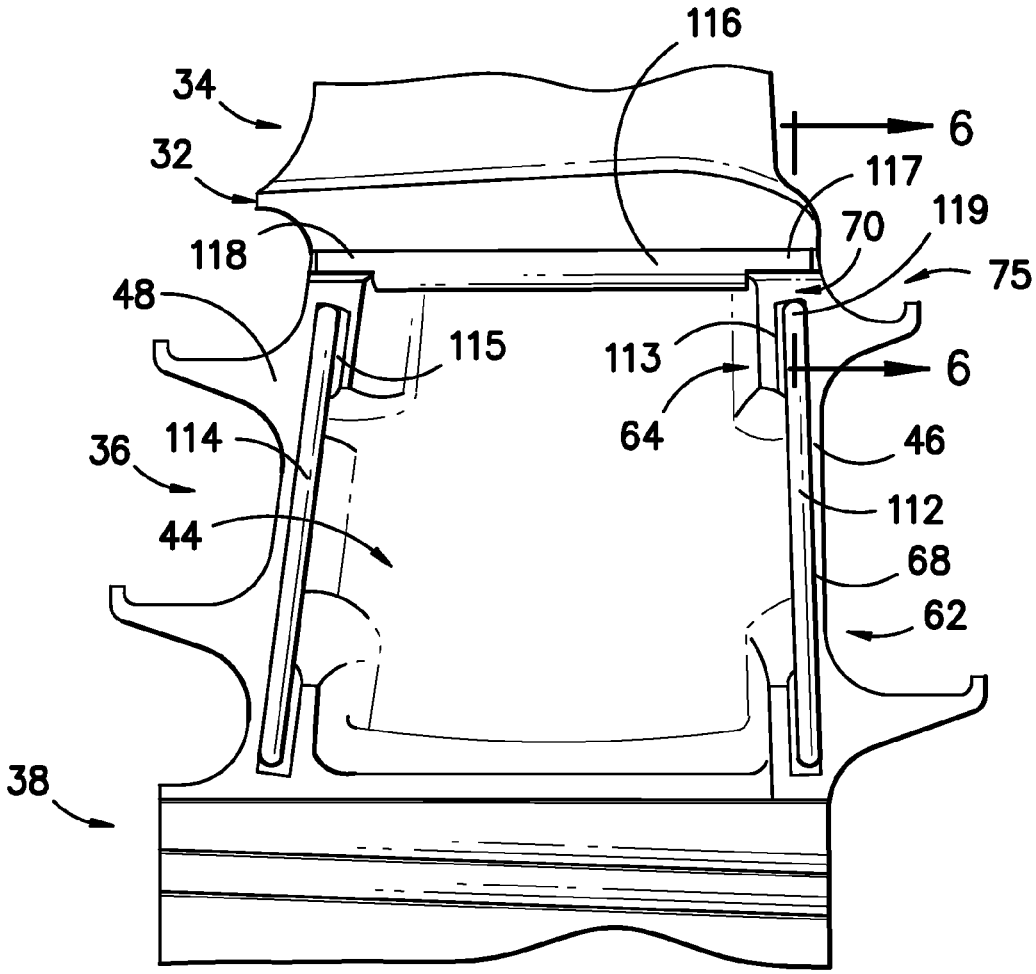
FIG. 5 is an opposite side view of a bucket assembly according to one embodiment of the present disclosure.
Figure 6:
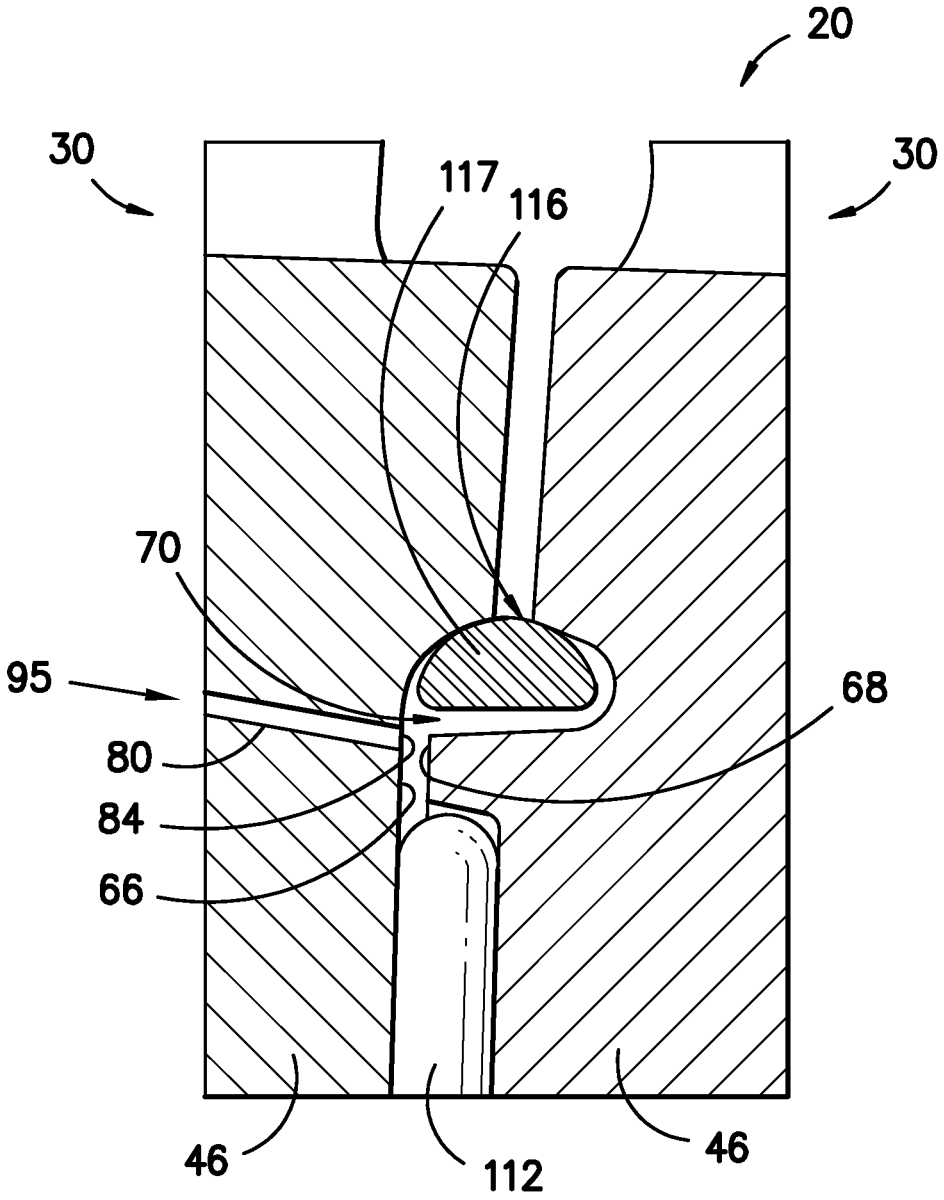
FIG. 6 is a cross-sectional view of a partial rotor assembly according to one embodiment of the present disclosure.
Figure 7:
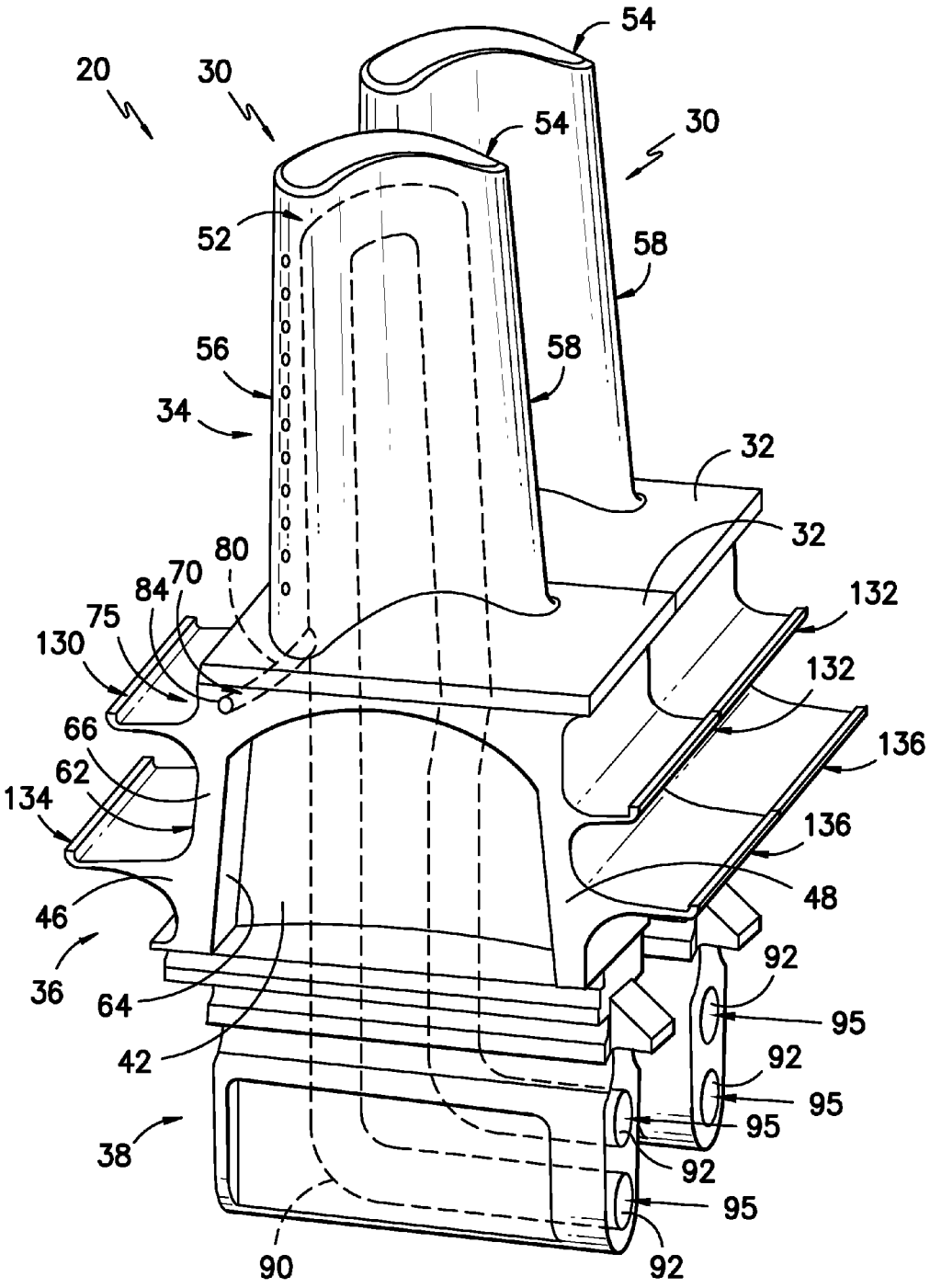
FIG. 7 is a perspective view of a partial rotor assembly according to one embodiment of the present disclosure.

The bucket assembly 30 may include an upstream seal pin 112. The upstream seal pin 112 may be disposed adjacent the upstream sidewall 46, as shown in FIG. 5. For example, the upstream seal pin 112 may be disposed adjacent the suction side surface 68 of the upstream sidewall 46, and may be disposed in a channel 113 defined in the suction side surface 68 of the upstream sidewall 46. Alternately, the channel 113 may be defined in the pressure side surface 66 of the upstream sidewall 46, and the upstream seal pin 112 may be disposed in the channel 113. Alternately, channels 113 may be defined in both the suction side surface 68 and the pressure side surface 66, and the upstream seal pin 112 may be disposed in the channel 113 defined in the suction side surface 68 of the upstream sidewall 46 as well as in the channel 113 defined in the pressure side surface 66 of the upstream sidewall 46 of an adjacent bucket assembly 30. The bucket assembly 30 may further include a downstream seal pin 114, which may be disposed adjacent the downstream sidewall 48 in a channel 115, as shown in FIG. 5. The channel 115 may be defined in the downstream sidewall 48 similarly to the channel 113 in the upstream sidewall 46. The seal pins 112 and 114 may be configured to provide a seal between the bucket assembly 30 and an adjacent bucket assembly 30. For example, during operation of the turbine 16, rotational forces may cause the seal pins 112 and 114 of a bucket 30 to interact with the upstream sidewall 46 and downstream sidewall 48, respectively, of the adjacent bucket 30, providing a seal between the bucket assemblies 30. As shown in FIG. 6, for example, the upstream seal pin 112 may interact with the pressure side surface 66 of the upstream sidewall 46, providing a seal between the bucket assemblies 30.

The bucket assembly 30 may further include a damper pin 116. The damper pin 116 may be disposed adjacent the platform 32 and the suction side sidewall 44, or the platform 32 and the pressure side sidewall 42. The damper pin 116 may include a leading end 117 and a trailing end 118. The leading end 117 may be disposed adjacent the upstream sidewall 46. The trailing end 118 may be disposed adjacent the downstream sidewall 48. The damper pin 116 may be configured to dampen vibrations between the bucket assembly 30 and an adjacent bucket assembly 30. For example, during operation of the turbine 16, rotational forces may cause the damper pin 116 of a bucket 30 to interact with the platform 32 of the adjacent bucket 30, dampen vibrations between the bucket assemblies 30, as shown in FIG. 6.

Figure 4:
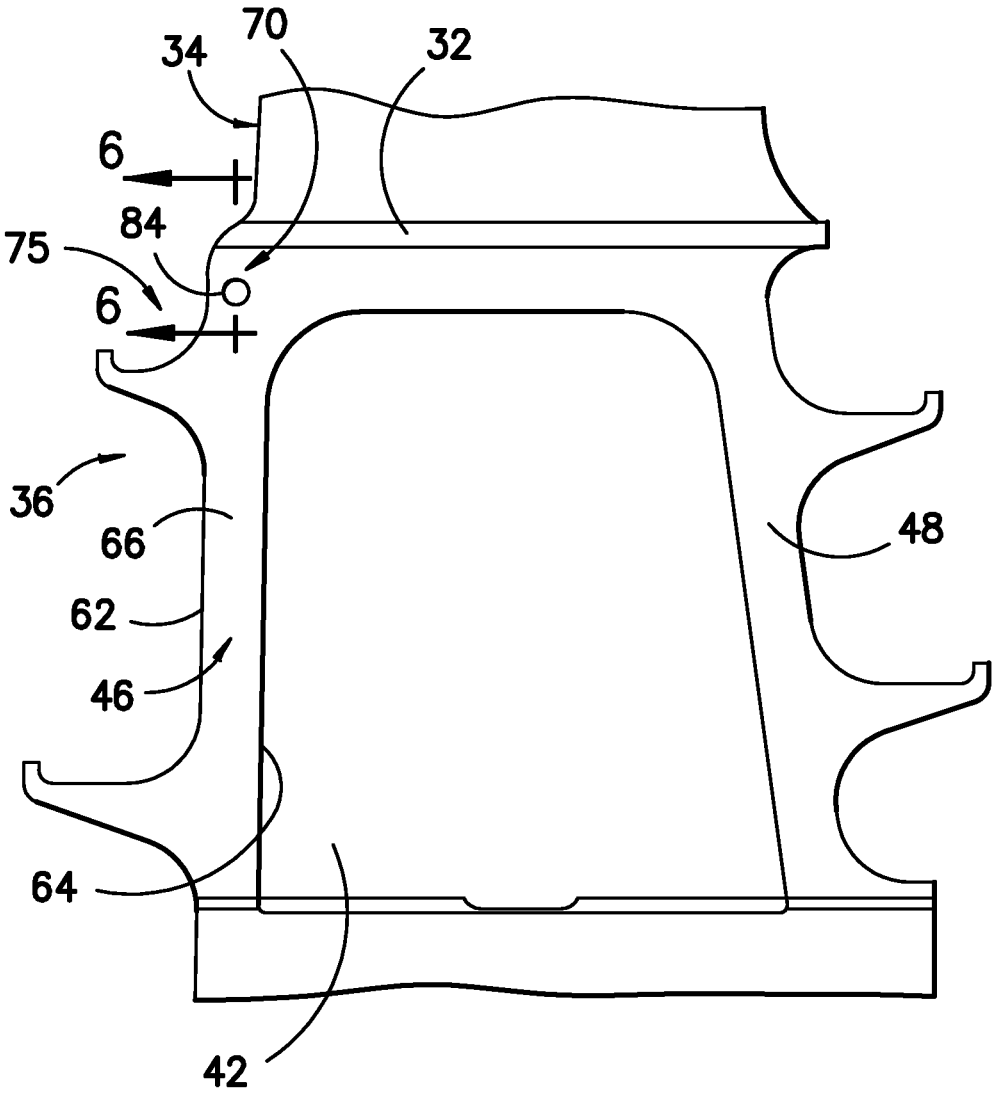
FIG. 4 is a side view of a bucket assembly according to one embodiment of the present disclosure.

The shank 36 of the bucket assembly 30 may further define an interior cooling passage 80. The cooling passage 80 may be configured to provide a portion of the cooling medium 95 from the cooling circuit 90 to the ingestion zone 70 of an adjacent bucket assembly 30. For example, the cooling passage 80 may extend from the cooling circuit 90 through the shank 36. In an exemplary aspect of an embodiment, the cooling passage 80 may extend from the cooling circuit 90 at least partially through the upstream sidewall 46 of the shank 36. However, the cooling passage 80 may also extend, partially or entirely, through the pressure side sidewall 42, the suction side sidewall 44, or the downstream sidewall 48. The cooling passage 80 may further include an exterior cooling passage opening 84, as shown in FIG. 4. The cooling passage opening 84 may be defined by the upstream sidewall 46, such as, for example, by the pressure side surface 66 of the upstream sidewall 46. Alternatively, the cooling passage opening 84 may be defined by the upstream sidewall 46 such as by the suction side surface 68 of the upstream sidewall 46. A portion of the cooling medium 95 may flow from the cooling circuit 90 through the cooling passage 80, and the cooling medium 95 may be exhausted from the cooling passage 80 through the cooling passage opening 84.

The cooling medium 95 may be provided through the cooling passage 80 and cooling passage opening 84 to the ingestion zone 70 of an adjacent bucket assembly 30. For example, in an exemplary aspect of an embodiment, a plurality of bucket assemblies 30 may be disposed circumferentially about the shaft 18 and coupled to the shaft 18, forming rotor assembly 20, as partially shown in FIGS. 6 and 7. Each bucket assembly 30 and adjacent bucket assembly 30 may define an ingestion zone 70 therebetween, as shown in FIG. 6.

In an exemplary aspect of an embodiment, the cooling medium 95 provided to the ingestion zone 70 may interact with at least a portion of the seal pin 112 of the adjacent bucket assembly 30, cooling the upstream seal pin 112. For example, as shown in FIG. 6, an upper end 119 of the upstream seal pin 112 may be disposed adjacent to or within the ingestion zone 70. The cooling medium 95 provided to the ingestion zone 70 may interact with the upper end 119 of the seal pin 112, cooling the upper end 119.

In one exemplary aspect of an embodiment, the exterior cooling passage opening 84 may be positioned upstream of the seal pin 112 with respect to the hot gas flow 28. In another exemplary aspect of an embodiment, the exterior cooling passage opening 84 may be substantially aligned with the seal pin 112 with respect to the hot gas flow 28. It should be understood, however, that the position of the exterior cooling passage opening 84 is not limited to a position upstream or in alignment with the seal pin 112, but may be anywhere on the shank 36 where the cooling medium 95 can be provided through the cooling passage opening 84 to the ingestion zone 70 of an adjacent bucket assembly 30.

In an exemplary aspect of an embodiment, the cooling medium 95 provided to the ingestion zone 70 may interact with at least a portion of the damper pin 116 of the adjacent bucket assembly 30, cooling the damper pin 116. For example, as shown in FIG. 6, the leading end 117 of the damper pin 116 may be disposed adjacent to or within the ingestion zone 70. The cooling medium 95 provided to the ingestion zone 70 may interact with the leading end 117 of the damper pin 116, cooling the leading end 117.

In one exemplary aspect of an embodiment, the cooling medium 95, upon exiting the cooling passage 80 through the cooling passage opening 84, may mix with the hot gas flow 28 in the ingestion zone 70, cooling the hot gas flow 28. For example, in one embodiment, the hot gas flow 28 may be at a temperature above approximately 1900° F. The cooling medium 95 may mix with the hot gas flow 28, cooling the hot gas flow 28 to a temperature below approximately 1900° F. In another exemplary aspect of an embodiment, the cooling medium 95, upon exiting the cooling passage 80 through the cooling passage opening 84, may provide an ingestion barrier. The ingestion barrier may prevent the hot gas flow 28 from entering the ingestion zone 70. For example, the cooling medium 95 may exit the cooling passage 80 at a pressure sufficient to provide a localized cooling outflow, resulting in an ingestion barrier.

The present disclosure is also directed to a method for cooling a bucket assembly 30. The method may include, for example, the step of providing a cooling medium 95 to a cooling circuit 90 within the bucket assembly 30. For example, the cooling medium 95 may be provided from the compressor 12 through the dovetail 38 or shank 36 to the cooling circuit 90, as discussed above. The method may further include, for example, the step of providing a portion of the cooling medium 95 from the cooling circuit 90 through an interior cooling passage 80 to an exterior ingestion zone 70 of an adjacent bucket assembly 30. The bucket assembly 30 may include a platform 32, an airfoil 34, a shank 36, and a dovetail 38, as discussed above.

The bucket assembly 30 may further include a seal pin 112, as discussed above. The bucket assembly 30 and the adjacent bucket assembly 30 may further define the ingestion zone 70 therebetween, and the cooling medium 95 provided to the ingestion zone 70 may interact with at least a portion of the seal pin 112 of the adjacent bucket assembly 30, cooling the seal pin 112, as discussed above.

The cooling passage 80 may include an exterior cooling passage opening 84, as discussed above. The cooling passage opening 84 may be positioned, for example, upstream of the seal pin 112 with respect to a hot gas flow 28, or substantially aligned with the seal pin 112 with respect to the hot gas flow 28, as discussed above.

The bucket assembly 30 may further include a damper pin 116, as discussed above. The bucket assembly 30 and the adjacent bucket assembly 30 may further define the ingestion zone 70 therebetween, and the cooling medium 95 provided to the ingestion zone 70 may interact with at least a portion of a leading end 117 of the damper pin 116 of the adjacent bucket assembly 30, cooling the leading end 117, as discussed above.

The cooling medium 95 may mix with a hot gas flow 28 in the ingestion zone 70, cooling the hot gas flow 28, as discussed above. Alternatively, the cooling medium 95 may provide an ingestion barrier. The ingestion barrier may prevent a hot gas flow 28 from entering the ingestion zone 70, as discussed above.

The amount of cooling medium 95 that is required to prevent ingestion of the hot gas flow 28, cool the seal pin 112, and cool the damper pin 116 according to the present disclosure may be a beneficially minimal amount. For example, the required amount of cooling medium 95 that is supplied to the turbine 16 and the various bucket assemblies 30 from the compressor 12 may be substantially lower than the amounts required by various other bucket component cooling devices and designs, such as pressurized shank designs. Thus, the minimal amount of cooling medium 95 that is required according to the present disclosure may provide significant decreases in the amount of cooling medium 95 wasted through leakage and emission in the turbine 16 of the gas turbine system 10. Further, the minimal amount of cooling medium 95 that is required according to the present disclosure may provide significant increases in the performance and efficiency of the turbine 16 and the gas turbine system 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An arrangement of bucket assemblies assembly comprising:

a platform;

an airfoil extending radially outward from the platform; and a shank extending radially inward from the platform, the shank including a pressure side sidewall, a suction side sidewall, an upstream sidewall, and a downstream sidewall, the sidewalls at least partially defining an internal cooling circuit, the cooling circuit configured to receive a cooling medium and provide the cooling medium to the airfoil, the upstream sidewall at least partially defining an interior cooling passage and at least partially defining an exterior ingestion zone, the cooling passage configured to provide a portion of the cooling medium from the cooling circuit to the ingestion zone of an adjacent bucket assembly through an opening of the cooling passage defined in one of a pressure side surface or a suction side surface of the upstream sidewall.

2. The arrangement of bucket assemblies of claim 1, further comprising a dovetail extending radially inward from the shank, the dovetail configured to couple the bucket assembly to a shaft and to supply the cooling medium to the cooling circuit.

3. The arrangement of bucket assemblies of claim 1, wherein the upstream sidewall includes an exterior surface, an interior surface, a pressure side surface, and a suction side surface, and wherein the ingestion zone is defined adjacent the suction side surface and the platform.

4. The arrangement of bucket assemblies of claim 1, further comprising a seal pin, the seal pin disposed adjacent the upstream sidewall and configured to provide a seal between the bucket assembly and the adjacent bucket assembly.

5. The arrangement of bucket assemblies of claim 4, wherein the bucket assembly and the adjacent bucket assembly further define the ingestion zone therebetween, and wherein the cooling medium provided to the ingestion zone interacts with at least a portion of the seal pin of the adjacent bucket assembly, cooling the seal pin.

6. The arrangement of bucket assemblies of claim 4, wherein the cooling passage includes an exterior cooling passage opening, the cooling passage opening positioned upstream of the seal pin with respect to a hot gas flow.

7. The arrangement of bucket assemblies of claim 4, wherein the cooling passage includes an exterior cooling passage opening, the cooling passage opening substantially aligned with the seal pin with respect to a hot gas flow.

8. The arrangement of bucket assemblies of claim 1, further comprising a damper pin disposed adjacent the platform, the damper pin including a leading end and a trailing end, the leading end disposed adjacent the upstream sidewall, the trailing end disposed adjacent the downstream sidewall, the damper pin configured to dampen vibrations between the bucket assembly and the adjacent bucket assembly.

9. The arrangement of bucket assemblies of claim 8, wherein the bucket assembly and the adjacent bucket assembly further define the ingestion zone therebetween, and wherein the cooling medium provided to the ingestion zone interacts with at least a portion of the leading end of the damper pin of the adjacent bucket assembly, cooling the leading end.

10. The arrangement of bucket assemblies of claim 1, wherein the cooling medium mixes with a hot gas flow in the ingestion zone, cooling the hot gas flow.

11. The arrangement of bucket assemblies of claim 1, wherein the cooling medium provides an ingestion barrier, the ingestion barrier preventing a hot gas flow from entering the ingestion zone.

12. A rotor assembly comprising:

a shaft;

a plurality of bucket assemblies, the bucket assemblies disposed circumferentially about the shaft and coupled to the shaft, each of the bucket assemblies comprising a platform, an airfoil extending radially outward from the platform, a shank extending radially inward from the platform, and a dovetail extending radially inward from the shank, the dovetail configured to couple the bucket assembly to the shaft, the shank including a pressure side sidewall, a suction side sidewall, an upstream sidewall, and a downstream sidewall, the sidewalls at least partially defining an internal cooling circuit, the cooling circuit configured to receive a cooling medium from the dovetail and provide the cooling medium to the airfoil, the upstream sidewall at least partially defining an interior cooling passage and at least partially defining an exterior ingestion zone, the cooling passage configured to provide a portion of the cooling medium from the cooling circuit to the ingestion zone of an adjacent bucket assembly through an opening of the cooling passage defined in one of a pressure side surface or a suction side surface of the upstream sidewall.

13. The rotor assembly of claim 12, wherein the upstream sidewall includes an exterior surface, an interior surface, a pressure side surface, and a suction side surface, and wherein the ingestion zone is defined adjacent the suction side surface and the platform.

14. The rotor assembly of claim 12, further comprising a seal pin, the seal pin disposed adjacent the upstream sidewall and configured to provide a seal between the bucket assembly and the adjacent bucket assembly.

15. The rotor assembly of claim 14, wherein the bucket assembly and the adjacent bucket assembly further define the ingestion zone therebetween, and wherein the cooling medium provided to the ingestion zone interacts with at least a portion of the seal pin of the adjacent bucket assembly, cooling the seal pin.

16. The rotor assembly of claim 14, wherein the cooling passage includes an exterior cooling passage opening, the cooling passage opening positioned upstream of the seal pin with respect to a hot gas flow.

17. The rotor assembly of claim 14, wherein the cooling passage includes an exterior cooling passage opening, the cooling passage opening substantially aligned with the seal pin with respect to a hot gas flow.

18. The rotor assembly of claim 12, further comprising a damper pin disposed adjacent the platform, the damper pin including a leading end and a trailing end, the leading end disposed adjacent the upstream sidewall, the trailing end disposed adjacent the downstream sidewall, the damper pin configured to dampen vibrations between the bucket assembly and the adjacent bucket assembly.

19. The rotor assembly of claim 18, wherein the bucket assembly and the adjacent bucket assembly further define the ingestion zone therebetween, and wherein the cooling medium provided to the ingestion zone interacts with at least a portion of the leading end of the damper pin of the adjacent bucket assembly, cooling the leading end.

* * * * *

UNITED STATES PATENT AND TRADEMARK OFFICE

CERTIFICATE OF CORRECTION

PATENT NO. : 8,540,486 B2
APPLICATION NO. : 12/728517
DATED : September 24, 2013
INVENTOR(S) : David Martin Johnson It is certified that error appears in the above-identified patent and that said Letters Patent is hereby corrected as shown below:

In the Claims

In claim 1, column 7, line 25 the word "assembly" should be deleted

Signed and Sealed this
Seventh Day of October, 2014

Michelle K. Lee

Michelle K. Lee
*Deputy Director of the United States Patent and Trademark Office*